US012152361B2

(12) United States Patent
Oh

(10) Patent No.: US 12,152,361 B2
(45) Date of Patent: Nov. 26, 2024

(54) TEMPORARY EARTH-RETAINING STRUCTURE USING GUIDE BRACKET, AND CONSTRUCTION METHOD THEREFOR

(71) Applicant: Yong Hwan Oh, Seoul (KR)

(72) Inventor: Yong Hwan Oh, Seoul (KR)

( * ) Notice: Subject to any disclaimer, the term of this patent is extended or adjusted under 35 U.S.C. 154(b) by 0 days.

(21) Appl. No.: 18/696,483

(22) PCT Filed: Aug. 14, 2023

(86) PCT No.: PCT/KR2023/012023
§ 371 (c)(1),
(2) Date: Mar. 28, 2024

(87) PCT Pub. No.: WO2024/039157
PCT Pub. Date: Feb. 22, 2024

(65) Prior Publication Data

US 2024/0263418 A1 Aug. 8, 2024

(30) Foreign Application Priority Data

Aug. 19, 2022 (KR) ..... 10-2022-0104080
Aug. 11, 2023 (KR) ..... 10-2023-0105449

(51) Int. Cl.

| | |
|---|---|
| ***E02D 17/04*** | (2006.01) |
| ***E02D 5/03*** | (2006.01) |
| ***E02D 5/28*** | (2006.01) |
| ***E02D 17/08*** | (2006.01) |

(52) U.S. Cl.
CPC ..... *E02D 17/04* (2013.01); *E02D 5/03* (2013.01); *E02D 5/28* (2013.01); *E02D 17/08* (2013.01); *E02D 2300/0034* (2013.01); *E02D 2600/20* (2013.01); *E02D 2600/30* (2013.01)

(58) Field of Classification Search
CPC .. E02D 17/04; E02D 5/03; E02D 5/28; E02D 17/08; E02D 2300/0034; E02D 2600/20; E02D 2600/30
See application file for complete search history.

(56) References Cited

FOREIGN PATENT DOCUMENTS

| | | | | |
|---|---|---|---|---|
| JP | 2013136921 | A | * | 7/2013 |
| KR | 100652530 | B1 | * | 12/2006 |
| KR | 101036173 | B1 | * | 5/2011 |
| KR | 101060287 | B1 | * | 8/2011 |
| KR | 10-1062179 | B1 | | 9/2011 |
| KR | 10-2015-0088406 | A | | 8/2015 |
| KR | 20150088406 | A | * | 8/2015 |
| KR | 20180060852 | A | * | 6/2018 |

(Continued)

OTHER PUBLICATIONS

International Search Report for PCT/KR/2023/012023 mailed on Nov. 22, 2023.

*Primary Examiner* — Kyle Armstrong
(74) *Attorney, Agent, or Firm* — The PL Law Group, PLLC

(57) ABSTRACT

A temporary earth-retaining structure uses a guide bracket. Tensile force can be directly applied to a pile by using a guide bracket having a simple structure. Mudslide and collapse caused by the earth pressure of backfill soil can be more effectively prevented by means of the tensile force directly applied to the pile. In addition, the guide bracket according to embodiments of the present invention has a simpler structure and is more easily constructed than a conventional bracket, and thus can be constructed at very low cost.

8 Claims, 9 Drawing Sheets

(56) References Cited

FOREIGN PATENT DOCUMENTS

| | | | | |
|---|---|---|---|---|
| KR | 10-1949086 | B1 | | 2/2019 |
| KR | 10-2021-0015490 | A | | 2/2021 |
| KR | 102315422 | B1 | * | 10/2021 |
| KR | 10-2382616 | B1 | | 4/2022 |
| KR | 10-2023-0030532 | A | | 3/2023 |

* cited by examiner

TEMPORARY EARTH-RETAINING STRUCTURE USING GUIDE BRACKET, AND CONSTRUCTION METHOD THEREFOR

CROSS REFERENCE TO RELATED APPLICATION AND CLAIM OF PRIORITY

This application claims benefit under 35 U.S.C. 119, 120, 121, or 365 (c), and is a National Stage entry from International Application No. PCT/KR2023/012023, filed Aug. 14, 2023, which claims priority to the benefit of Korean Patent Application Nos. 10-2022-0104080 filed in the Korean Intellectual Property Office on Aug. 19, 2022 and 10-2023-0105449 filed in the Korean Intellectual Property Office on Aug. 11, 2023, the entire disclosures of which are incorporated herein by reference.

BACKGROUND

1. Technical Field

The present invention relates to temporary earth-retaining structure and a construction method therefor, and more particularly, to a technology for preventing a pile from falling or collapsing by applying a rear-side load to an upper portion (head) of the pile using a guide bracket.

2. Background Art

Generally, at engineering or building civil construction sites, temporary earth-retaining structures are installed to prevent soil disposed at a rear side of excavated soil (i.e., backfill soil) from being introduced into the soil to be excavated (i.e., excavated soil). The temporary earth-retaining structures may be made of thumb piles, earthen plates, wales, struts, etc., and prevent a space to be excavated from collapsing due to an earth pressure of the backfill soil.

Various earth-retaining methods, such as earth anchors and C.I.P., are used as earth-retaining methods to construct temporary earth-retaining structures. However, there are problems that conventional earth-retaining methods either have difficulty effectively applying tensile force to the pile, or require complex structures and excessive construction cost to directly apply the tensile force to the pile.

SUMMARY

The present invention provides a simpler structure and method to stably apply a rear load to an upper portion (head) of a pile, and in particular, equally distributes tensile force caused by a tensile member throughout a full width of a flange of the pile to effectively prevent the pile from falling or collapsing.

According to an exemplary embodiment, a temporary earth-retaining structure using a guide bracket includes: a pile (110) having a H-beam shape and provided with a first flange (112) at a backfill soil side and a second flange (114) at an excavated soil side; a ground anchor (120) provided with an anchor (122) of which one end is anchored to a lower portion of backfill soil and a tensile member (124) extending from the other end of the anchor (122) to sequentially pass through the first flange (112) and the second flange (114); and a guide bracket (130) disposed on a ground of the backfill soil while being fixed to the first flange (112) at an upper portion of the pile (110), and changing a direction of the tensile member (124), which is wired parallel to a longitudinal direction of the pile (110) into a direction perpendicular to the longitudinal direction of the pile (110) from a lower portion of the backfill soil so as to be guided toward the second flange (124), wherein the guide bracket (130) includes: a plurality of side plates (132, 133) spaced a predetermined distance from each other on the first flange (112) to protrude toward the outside of the first flange (112) and provided in a plate shape to prevent the tensile member (124) from being separated outward from a side surface of the guide bracket (130); and a direction change rotation plate (131) disposed between the plurality of side plates (132, 133) at outer ends of the plurality of side plates (132, 133) and having a curved contact surface with the tensile member (124) so that the tensile member (124) is changed in direction perpendicular to the longitudinal direction of the pile (110), wherein the tensile member (124) includes a first tensile member (124*a*) and a second tensile member (124*b*), wherein the first tensile member (124*a*) and the second tensile member (124*b*) are disposed adjacent to each other at the other end of the anchor (122) so as to be integrated with each other, wherein, as the first tensile member (124*a*) and the second tensile member (124*b*) are closer to the direction change rotation plate (131) from the other end of the anchor (122), a spaced distance therebetween increases, and the first tensile member (124*a*) and the second tensile member (124*b*) sequentially pass through the first flange (122) and the second flange (124) in a state which the spaced distance therebetween from a point that is in contact with the direction change rotation plate (131) is constantly maintained.

The first tensile member (124*a*) and the second tensile member (124*b*) may be wired to be adjacent to inner surfaces of the plurality of side plates (132, 133) so as to be spaced at a predetermined distance from the inside of the guide bracket (130), and a rounded protrusion (135) configured to maintain the spaced distance between the first tensile member (124*a*) and the second tensile member (124*b*) and fix positions of the first tensile member (124*a*) and the second tensile member (124*b*) on the direction change rotation plate (131) so that tensile force caused by the first tensile member (124*a*) and the second tensile member (124*b*) is equally distributed throughout a full width of the first flange (112) may be provided to protrude from a top surface of the direction change rotation plate (131).

The direction change rotation plate (131) may be seated and fixed on a bottom plate (136) disposed perpendicular to the first flange 112 between the plurality of side plates (132, 133), and the bottom plate (136) may be provided to protrude in a direction perpendicular to the first flange (112) so as to be supported by a rib (137) attached to a lower portion of the bottom plate (136).

The rounded protrusion (135) may be provided to be spaced a predetermined distance from each of the inner surfaces of the plurality of side plates (132, 133) from a top surface of the direction change rotation plate (131).

The rounded protrusion (135) may have a curved shape that is inclined so that a protruding height of the rounded protrusion (135) on the top surface of the direction change rotation plate (131) decreases as it moves from a central portion to an edge of the rounded protrusion (135).

A groove may be provided in the top surface of the direction change rotation plate (131) to seat the rounded protrusion (135), and the rounded protrusion (135) may be seated and assembled in the groove.

At upper ends of the plurality of side plates (132, 133) adjacent to the first flange (112), an upper plate (134) configured to prevent the first tensile member (124*a*) and the second tensile member (124*b*) from being separated outward from an upper side of the guide bracket (130) may be disposed between the plurality of side plates (132, 133).

According to another exemplary embodiment, a method for constructing the temporary earth-retaining structure by using the above-described guide bracket (130) includes: forming a first drill hole inside backfill soil; anchoring a ground anchor (120) in the first drill hole; inserting a pile (110) into a second drill hole formed to be spaced a predetermined distance from the first drill hole; installing the guide bracket (130) on an upper portion of the pile (110); changing a direction of each of first tensile member (124*a*) and the second tensile member (124*b*), which are wired parallel to a longitudinal direction of the pile (110) from a lower portion of the backfill soil, to a direction perpendicular to the longitudinal direction of the pile (110) by the guide bracket (130) so as to be guided from the first flange (112) to the second flange (114); tensioning the first tensile member (124*a*) and the second tensile member (124*b*); and allowing the first tensile member (124*a*) and the second tensile member (124*b*) to be spaced a predetermined distance from each other by a direction change rotation plate (131) and a rounded protrusion (135) of the guide bracket (130) in the process of tensioning the first tensile member (124*a*) and the second tensile member (124*b*) so that tensile force by the first tensile member (124*a*) and the second tensile member (124*b*) is equally distributed throughout a full width of the first flange (112).

According to the embodiments of the present invention, the tensile force may be directly applied to the pile by using the guide bracket having the simple structure. Here, the mudslide and collapse caused by the earth pressure of the backfill soil may be more effectively prevented by means of the tensile force directly applied to the pile. In addition, the guide bracket according to the embodiments of the present invention may have the simpler structure and be more easily constructed than the conventional bracket and thus may be constructed at the very low cost.

DETAILED DESCRIPTION

Hereinafter, embodiments of the present invention will be described in detail with reference to the accompanying drawings. The following detailed descriptions are provided to help comprehensive understanding of a method, an apparatus, and/or a system described in this specification. However, this is merely an example, and the present invention is not limited thereto.

In descriptions of embodiments of the present invention, detailed descriptions related to the well-known technologies will be ruled out in order not to unnecessarily obscure subject matters of the present invention. Also, terms used in the present specification are terms defined in consideration of functions according to embodiments, and thus the terms may be changed according to the intension or usage of a user or operator. Therefore, the terms should be defined on the basis of the overall contents of this specification. The terms used in the present specification are merely used to describe particular embodiments, and are not intended to limit the present invention. An expression used in the singular encompasses the expression in the plural, unless it has a clearly different meaning in the context. In the present specification, it is to be understood that terms such as "including" or "having", etc., are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

Figure 1:
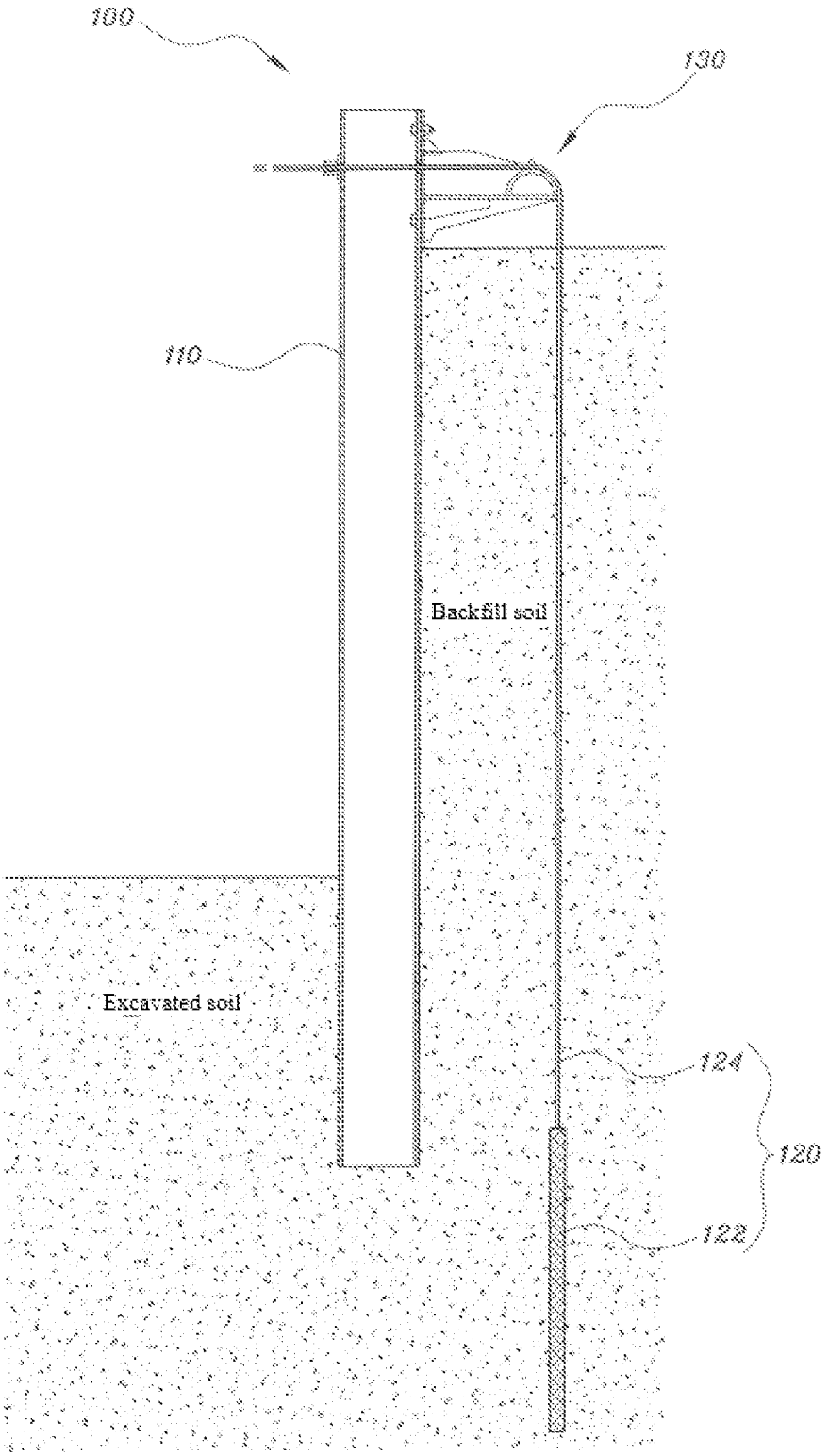
FIG. 1 is a view illustrating an example of a construction site at which a temporary earth-retaining structure is applied according to an embodiment of the present invention.
Figure 2:
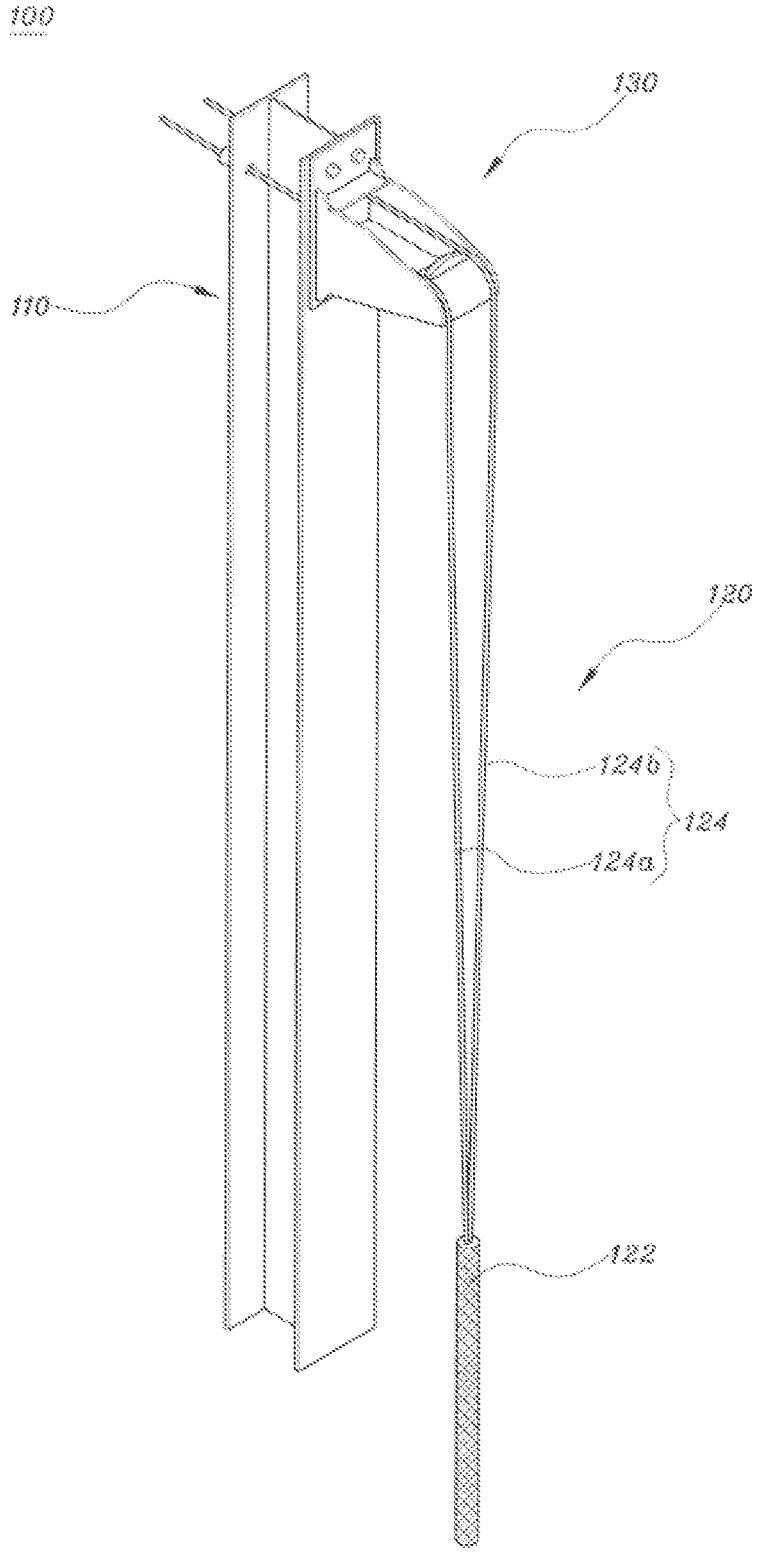
FIG. 2 is a perspective view of the temporary earth-retaining structure according to an embodiment of the present invention.
Figure 3:
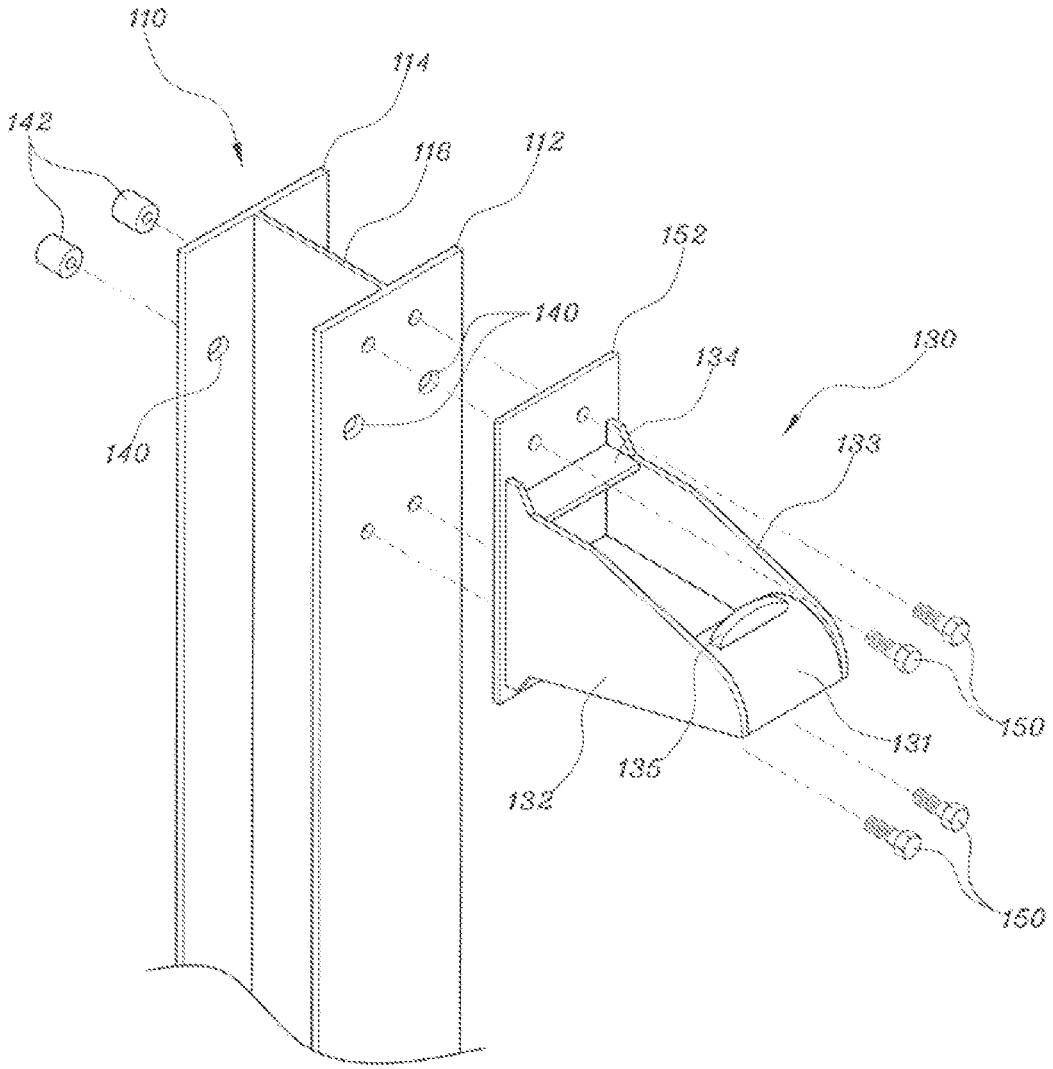
FIG. 3 is an exploded view of the temporary earth-retaining structure according to an embodiment of the present invention.
Figure 4:
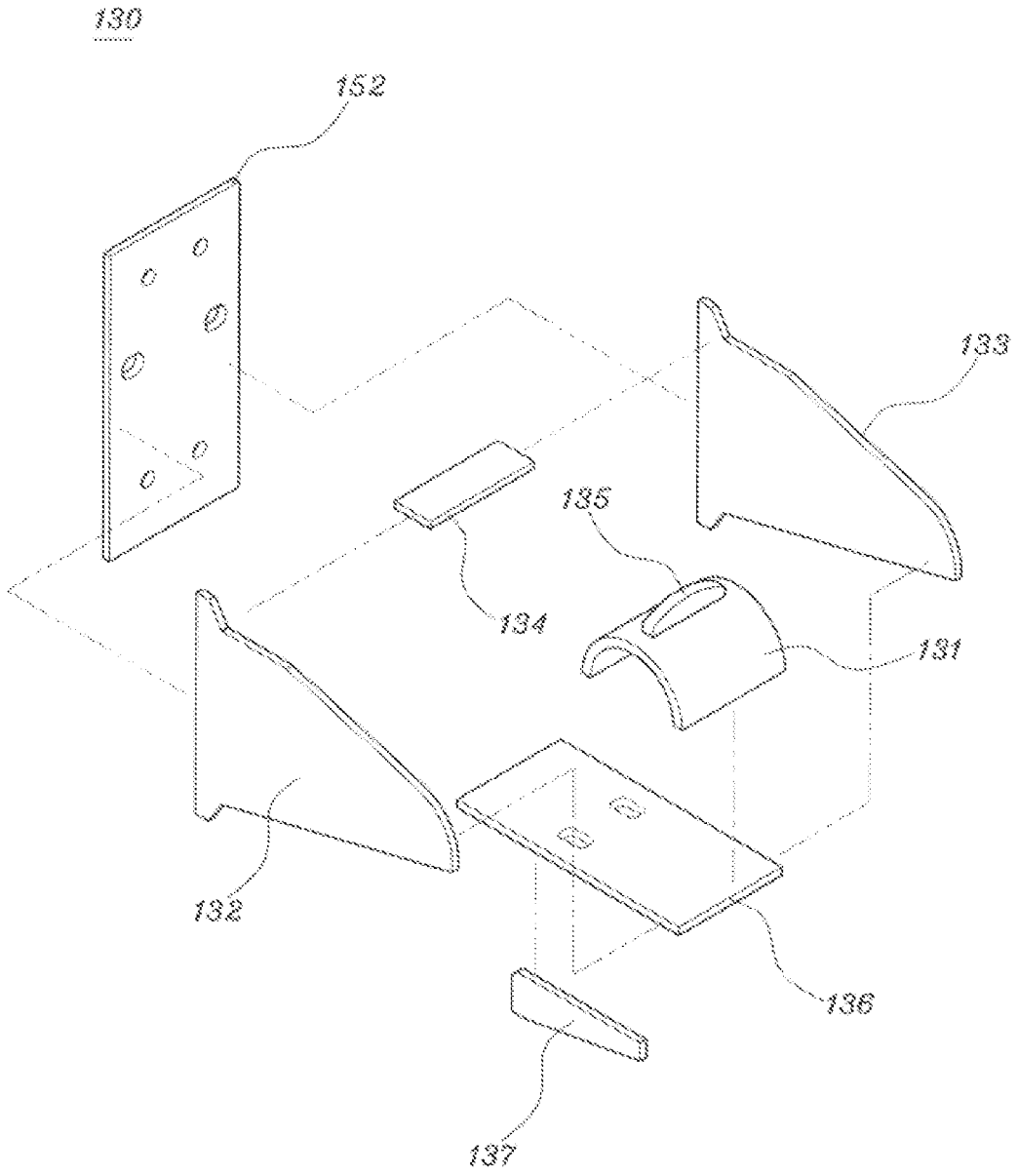
FIG. 4 is an exploded view of a guide bracket according to an embodiment of the present invention.

FIG. 1 is a view illustrating an example of a construction site at which a temporary earth-retaining structure 100 is applied according to an embodiment of the present invention, and FIG. 2 is a perspective view of the temporary earth-retaining structure 100 according to an embodiment of the present invention. In addition, FIG. 3 is an exploded view of the temporary earth-retaining structure 100 according to an embodiment of the present invention, and FIG. 4 is an exploded view of a guide bracket 130 according to an embodiment of the present invention.

As illustrated in FIGS. 1 to 4, a temporary earth-retaining structure 100 is a facility installed to prevent backfill soil from being introduced into an excavated soil side at a construction site, and includes a pile 110, a ground anchor 120, and a guide bracket 130. In the present embodiments, the excavated soil refers to soil excavated by an excavator for underground construction at the construction site, and the backfill soil refers to soil disposed at a rear side of the excavated soil and supported by the temporary earth-retaining structure 100.

The pile 110 is provided in an H-beam shape and includes a first flange 112, a second flange 114, and a web 116. Here, the first flange 112 may be disposed to face a backfill soil side, and the second flange 114 may be disposed to face an opposite side of the first flange 112, that is, an excavated soil side. In addition, the web 116 is disposed between the first flange 112 and the second flange 114 to connect the first flange 112 to the second flange 114.

The ground anchor 120 is a device that provides tensile force to the pile 110 so that the pile 110 has resistance to an earth pressure of the backfill soil and includes an anchor 122 and a tensile member 124. One end of the anchor 122 may be fixed to a lower portion of the backfill soil. In addition, the tensile member 124 may extend from the other end of the anchor 122 and be wired parallel to a longitudinal direction of the pile 110 up to a ground surface and then be changed in wired direction to an angle of 90 degrees while passing through the guide bracket 130, which will be described later, to sequentially pass through the first flange 112 and the second flange 114.

In addition, the tensile member 124 may be constituted by a first tensile member 124*a* and a second tensile member 124*b*. The first tensile member 124*a* and the second tensile member 124*b* may be disposed adjacent to each other at the other end of the anchor 122 so as to integrated with each other, and as the first tensile member 124*a* and the second tensile member 124*b* are closer to the guide bracket 130 from the other end of the anchor 122, a spaced distance between the first tensile member 124*a* and the second tensile member 124*b* may increase. In addition, the first tensile member 124*a* and the second tensile member 124*b* may sequentially pass through the first flange 112 and the second flange 114 in a state in which the spaced distance therebetween is maintained from a point that is in contact with the guide bracket 130.

The guide bracket 130 is a device that changes the wired direction of the tensile member 124 of the ground anchor 120 to 90 degrees so that the tensile member 124 directly applies the tensile force to the pile 110. The guide bracket 130 may be fixed to the first flange 112 at an upper portion of the pile 110 and may be disposed to protrude above the ground of the backfill soil. The guide bracket 130 may change the direction of the tensile member 124, which is wired parallel to the longitudinal direction of the pile 110 at the lower portion of the backfill soil, to a direction perpendicular to the longitudinal direction of the pile 110 to guide the tensile member 124 toward the second flange 114. For this, the guide bracket 130 may include a direction change rotation plate 131, a first side plate 132, a second side plate 133, an upper plate 134, a rounded protrusion 135, a bottom plate 136, and a rib 137.

The direction change rotation plate 131 is disposed between the plurality of side plates 132 and 133 at outer ends of the plurality of side plates 132 and 133, which will be described later, to change the direction of the tensile member 124 by 90 degrees. That is, the direction change rotation plate 131 may change the direction of the tensile member 124 wired parallel to the longitudinal direction of the pile 110 at the lower portion of the backfill soil to a direction perpendicular to the longitudinal direction of the pile 110. For this, a contact surface of the direction change rotation plate 131 that is in contact with the tensile member 124 may have a curved shape. For example, the direction change rotation plate 131 may have a semicircular shape, and at least a portion of the outer surface of the direction change rotation plate 131 may be in contact with the tensile member 124. The direction change rotation plate 131 may be seated and fixed on the bottom plate 136, which will be described later, and may be supported by the bottom plate 136 and the rib 137 attached to a lower portion of the bottom plate 136.

Each of the first side plate 132 and the second side plate 133 may be provided in a plate shape to prevent the tensile member 124 from being separated outward from a side surface of the guide bracket 130. The first side plate 132 and the second side plate 133 may be spaced a predetermined distance from each other on the first flange 112 to protrude toward the outside of the first flange 112. Thus, the first tensile member 124*a* and the second tensile member 124*b* may be wired adjacent to inner surfaces of the first side plate 132 and the second side plate 133, respectively, and thus may be prevented from the outside of the guide bracket 130 by the first side plate 132 and the second side plate 133.

In addition, the upper plate 134 may be disposed at upper ends of the side plates 132 and 133 adjacent to the first flange 112 to prevent the tensile member 124 from being separated outward from an upper side of the guide bracket 130. The upper plate 134 may be provided to protrude toward the outside of the first flange 112 between the first side plate 132 and the second side plate 133. The first tensile member 124*a* and the second tensile member 124*b* may be wired under the upper plate 134 and may not be separated from the outside of the guide bracket 130 by the upper plate 134.

The rounded protrusion 135 may be provided to protrude from a top surface of the direction change rotation plate 131 so as to maintain the spaced distance between the first tensile member 124*a* and the second tensile member 124*b* and to fix positions of the first tensile member 124*a* and the second tensile member 124*b* on the direction change rotation plate 131.

As described above, the first tensile member 124*a* and the second tensile member 124*b* may be disposed adjacent to each other at the other end of the anchor 122 so as to integrated with each other, and as the first tensile member 124*a* and the second tensile member 124*b* are closer to the guide bracket 130 from the other end of the anchor 122, the spaced distance between the first tensile member 124*a* and the second tensile member 124*b* may increase. In addition, the first tensile member 124*a* and the second tensile member 124*b* may be changed in the direction perpendicular to the longitudinal direction of the pile 110 by the direction change rotation plate 131 to sequentially pass through the first flange 122 and the second flange 124. Thereafter, the first tensile member 124*a* and the second tensile member 124*b* may be tensioned by separate hydraulic equipment (not shown). However, in the case of each of the first tensile member 124*a* and the second tensile member 124*b*, its weight and strength may be very high and thus may be shaken left and right due to eccentricity during the tensioning process. In this case, local buckling may occur in the pile 110, and the local buckling may cause torsional buckling, which may cause twisting and collapse of the pile 110.

Thus, in the present invention, the positions of the first tensile member 124*a* and the second tensile member 124*b* on the direction change rotation plate 131 may be fixed, and the rounded protrusion 135 may be provided to protrude from the top surface of the direction change rotation plate 131 so that the tensile force due to the first tensile member 124*a* and the second tensile member 124*b* is evenly distributed throughout a full width of the flange 112. Due to the equal distribution effect of the tensile force caused by the rounded protrusion 135, the local buckling, the torsional buckling, the twisting, and the collapse of the pile 100 may be prevented.

The rounded protrusion 135 may be provided to protrude from the top surface of the direction changing rotary plate 131 and be provided in a curved shape that is inclined so that a protruding height of rounded protrusion 135 on the top surface of the direction change rotation plate 131 gradually decreases from a central portion to an edge of the rounded protrusion 135. Thus, even if the first tensile member 124*a* and the second tensile member 124*b* are disposed at an upper side of the rounded protrusion 135 during the tensioning process, the first tensile member 124*a* and the second tensile member 124*b* may be guided to the outside of the edge of the rounded protrusion 135.

The rounded protrusions 135 may be provided to be spaced a predetermined distance from the inner surfaces of the plurality of side plates 132 and 133 on the top surface of the direction change rotation plate 131, and thus, the first tensile member 124*a* and the second tensile member 124*b* may be naturally seated between the inner surfaces of the plurality of side plates 132 and 133 and the direction change rotation plate 131. In addition, the first tensile member 124*a* and the second tensile member 124*b* may be wired to be adjacent to the inner surfaces of the plurality of side plates 132 and 133, and thus, the tensile force applied to the pile 110 by the first tensile member 124*a* and the second tensile member 124*b* may be maximized.

To explain in more detail the reason for installing the above-mentioned rounded protrusion 135, when constructing a crawler drill (not shown) for anchoring the ground anchor 120 at a rear side of the pile 110, center lines in a steel axis direction of the pile 110 may be matched to each other through the rounding jaw 135 when constructing a drilling machine for the installation position of the ground anchor 120 and for inserting the pile 110 (i.e., H beam). In addition, due to the installation of the rounded protrusion 135, when the first tensile member 124*a* and the second tensile member 124*b* are tensioned through hydraulic equipment (not shown), problems in which the first tensile member 124*a* and the second tensile member 124*b* are biased on the direction change rotating plate 131, or the pile 110 is rotated due to eccentricity may be prevented, and in particular, structural stability of the pile 110 may be maintained by ensuring that multiple strands of the tensile members 124*a* and 124*b* are equally distributed throughout the full width of the flange.

A groove for seating the rounded protrusion 135 may be provided in the top surface of the direction change rotation plate 131, and the rounded protrusion 135 may be assembled by being seated in the groove. Due to the simple structure and mutual assembly of the direction change rotation plate 131 and the rounded protrusion 135, the tensile effect and stability of the pile 100 by the first tensile member 124*a* and the second tensile member 124*b* may be improved by simpler construction.

The bottom plate 136 may be a plate that supports the direction change rotation plate 131 and may be disposed perpendicular to the first flange 112 between the first side plate 132 and the second side plate 133. The direction change rotation plate 131 may be seated and fixed on the bottom plate 136.

The rib 137 is attached to a lower portion of the bottom plate 136 to stably supports the guide bracket 130. The guide bracket 130 may directly transmit the tensile force generated by the tensile member 124 toward the pile 110, thereby receiving a large amount of force. Thus, the rib 137 may be provided to protrude in a direction perpendicular to the first flange 112 and be attached to the lower portion of the bottom plate 136, and thus, the bottom plate 136 and the guide bracket 130 may be stably supported on the lower portion of the bottom plate 136.

As described above, according to the embodiments of the present invention, the tensile force may be directly applied to the pile 110 by using the guide bracket 130 having the simple structure. Here, mudslide and collapse caused by the earth pressure of the backfill soil may be more effectively prevented by the tensile force directly applied to the pile 110. In addition, the guide bracket 130 according to the embodiments of the present invention may have the simpler structure and be more easily constructed than the conventional bracket and thus may be constructed at the very low cost.

Figure 5:
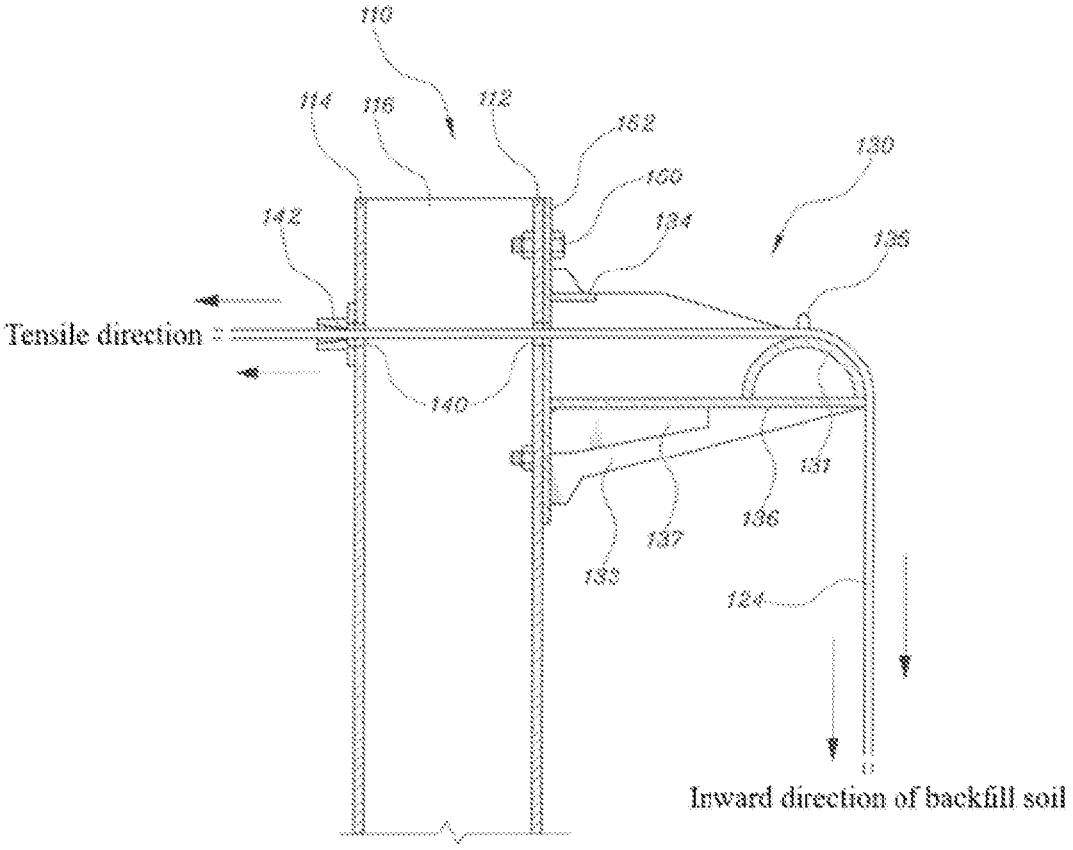
FIG. 5 is a cross-sectional view of the guide bracket according to an embodiment of the present invention.
Figure 6:
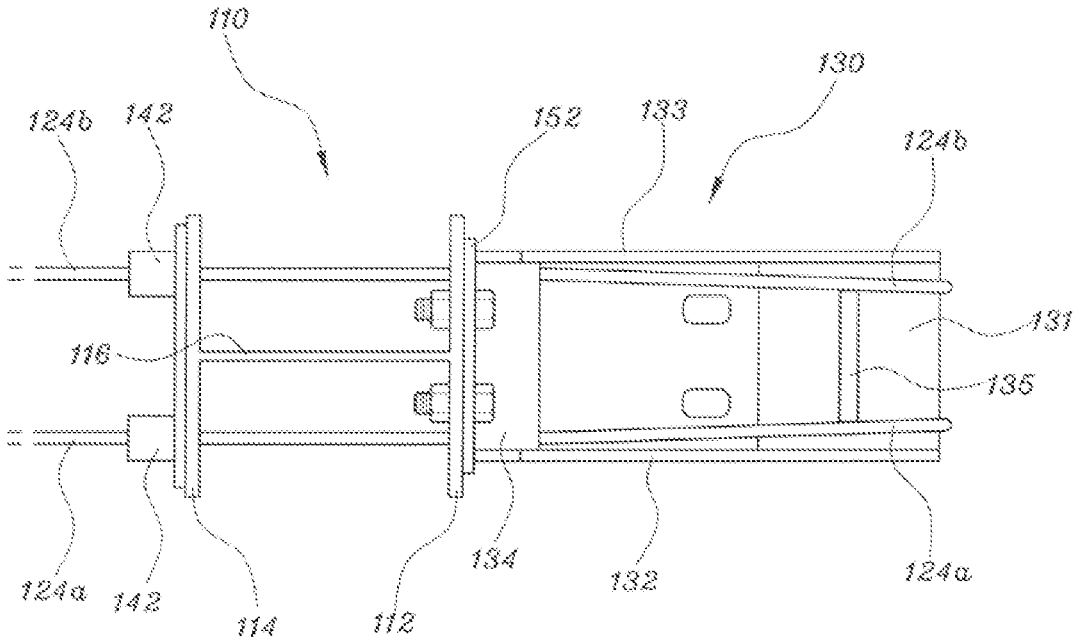
FIG. 6 is a plan view of the guide bracket according to an embodiment of the present invention.
Figure 7:
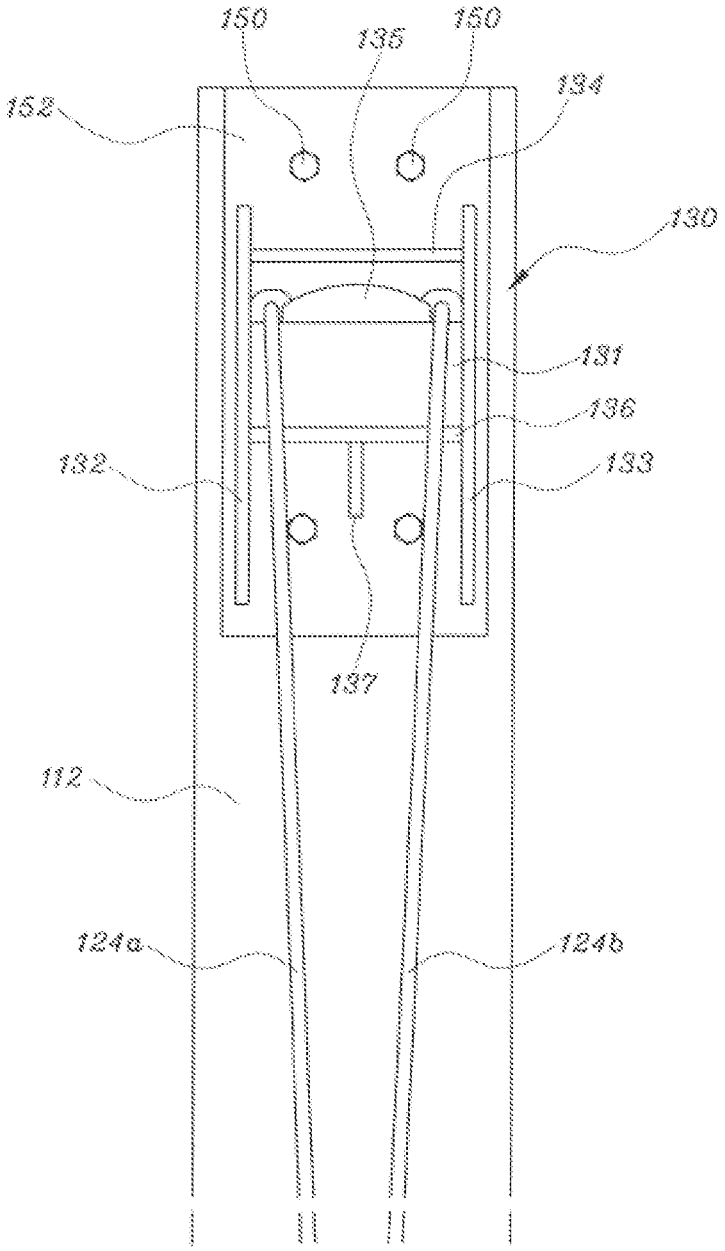
FIG. 7 is a front view of the guide bracket according to an embodiment of the present invention.

FIG. 5 is a cross-sectional view of the guide bracket 130 according to an embodiment of the present invention, and FIG. 6 is a plan view of the guide bracket 130 according to an embodiment of the present invention. FIG. 7 is a front view of the guide bracket 130 according to an embodiment of the present invention. The guide bracket 130 may be fixed to the first flange 112 through one or more coupling units 150. Here, a coupling plate 152 may be attached to the first flange 112, and the guide bracket 130 may be fixed to the first flange 112 through the coupling plate 152. The coupling unit 150 may connect and fix the first flange 112 and the coupling plate 152 to each other.

As described above, the guide bracket 130 may include a direction change rotation plate 131, a first side plate 132, a second side plate 133, an upper plate 134, a rounded protrusion 135, a bottom plate 136, and a rib 137.

Here, the tensile member 124 may be wired parallel to the longitudinal direction of the pile 110 from the lower portion of the backfill soil, which is an anchoring point of the anchor 122, to the ground surface and then changed in direction to 90 degrees by the direction change rotation plate 131 to sequentially pass through the first flange 112 and the second flange 114. The tensile member 124 may be wired to sequentially pass through the first flange 112 and the second flange 114 and may be tensioned in the direction in which the tensile member passes through the first flange 112 and the second flange 114. One or more through-holes 140 through which the tensile member 124 passes may be defined in one surface of each of the first flange 112 and the second flange 114, and the tensile member 124 may pass through the through-hole 140 and then be wired toward the tensile direction illustrated in FIG. 5. In addition, for the stable anchoring of the tensile member 124, a tensile member anchorage 142 may be provided at a point at which the through-hole 140 is defined.

In addition, the tensile member 124 may be stably wired without being separated from the guide bracket 130 by the first side plate 132, the second side plate 133, and the upper plate 134. In addition, the tensile member 124 may be guided and fixed in position on the guide bracket 130 by the rounded protrusion 135 protruding from the top surface of the direction change rotation plate 131, and an occurrence of tangles, interference, and distortion between the first tensile member 124*a* and the second tensile member 124*b* may be prevented by the rounded protrusion 135, and thus, the local buckling, the torsional buckling, the distortion, and the collapse of the pile 100 may be prevented. In particular, according to embodiments of the present invention, the tensile force caused by the first tensile member 124*a* and the second tensile member 124*b* may be distributed equally throughout the full width of the first flange 112, and thus, the tensile force by the first tensile member 124*a* and the second tensile member 124 may be maximized, and also, the local buckling, the torsional buckling, the twisting, and the collapse of the pile 100 due to the tensile force may be prevented more efficiently.

Figure 8:
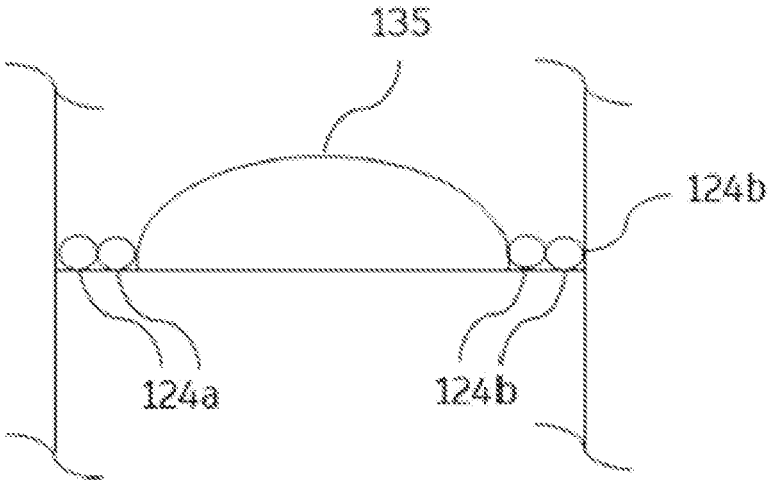
FIG. 8 is a view illustrating an example of a wire of a tensile member according to another embodiment of the present invention.

FIG. 8 is a view illustrating an example of a wire of a tensile member 124 according to another embodiment of the present invention.

As illustrated in FIG. 8, the tensile member 124 may include a plurality of first tensile members 124*a* and a plurality of second tensile members 124*b*. As an example, two first tensile members 124*a* may be wired at a left side of a rounded protrusion 135, and two second tensile members 124*b* may be wired at a right side of the rounded protrusion 135. That is, each of the first tensile member 124*a* and the second tensile member 124*b* may be provided in 1, 2, 3, . . . , as necessary, and in this case, the total number of tensile members 124 may be 2, 4, 6, . . . .

Figure 9:
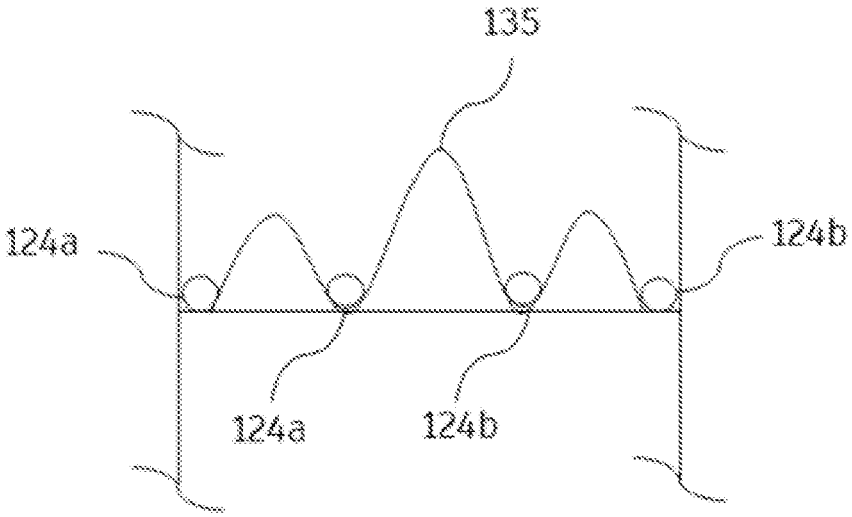
FIG. 9 is a view illustrating an example of a rounded protrusion according to another embodiment of the present invention.

FIG. 9 is a view illustrating an example of a rounded protrusion 135 according to another embodiment of the present invention.

As illustrated in FIG. 9, the rounded protrusion 135 according to another embodiment of the present invention may have a cross-sectional shape of which an unevenness of a curved surface is repeated. That is, the rounded protrusion 135 may be provided to be inclined so that a protruding height of the rounded protrusion 135 on a top surface of a direction change rotation plate 131 becomes smaller as it goes from a central portion to an edge of the rounded protrusion 135 and be provided in a cross-sectional shape of which the unevenness of the curved surface is repeated. For example, the rounded protrusion 135 may have an uneven cross-section.

Figure 10:
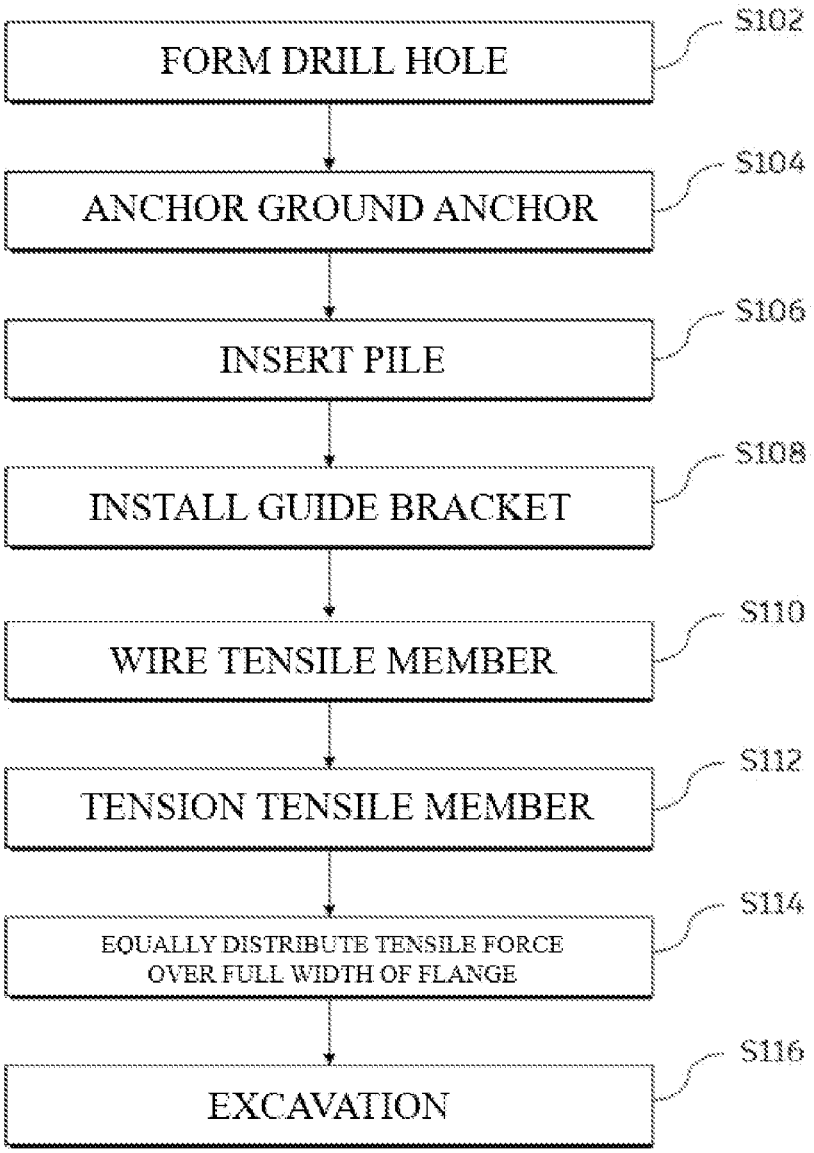
FIG. 10 is a flowchart for explaining a construction method of a temporary earth-retaining structure using a guide bracket according to an embodiment of the present invention.

FIG. 10 is a flowchart for explaining a construction method of a temporary earth-retaining g structure using a guide bracket according to an embodiment of the present invention. In the illustrated flowchart, the method may be divided into a plurality of steps, but at least some of the steps may be performed in a different order, combined with other steps, omitted, or divided into detailed steps, or one or more steps (not shown) may be additionally performed.

In operation S102, a first drill hole is formed inside backfill soil.

In operation S104, a ground anchor 120 is inserted into the first drill hole and anchored.

In operation S106, a pile 110 is inserted into the second drill hole formed at a certain distance from the first drill hole. Thereafter, soil and sand may be filled into the first and second drill holes and then compacted.

In operation S108, a guide bracket 130 is installed on an upper portion of the pile 110. Specifically, a guide bracket 130 may be installed at the upper portion of the pile 110 so as to be fixed to a first flange 112 and protrude above a ground surface of the backfill soil.

In operation S110, a first tensile member 124*a* and a second tensile member 124*b*, which are wired parallel to a longitudinal direction of the pile 110 from a lower part of the backfill soil, may be changed to a direction perpendicular to the longitudinal direction of the pile 110 by a guide bracket 130 and be guided from the first flange 112 to the second flange 114.

In operation S112, the first tensile member 124*a* and the second tensile member 124*b* are tensioned. The first tensile member 124*a* and the second tensile member 124*b* may be tensioned by separate hydraulic equipment (not shown).

In operation S114, in the process of tensioning the first tensile member 124*a* and the second tensile member 124*b*, the first tensile member 124*a* and the second tensile member 124*b* may be spaced a predetermined distance from each other by a direction change rotating plate 131 and a rounded protrusion 135 of the guide bracket 130, and thus, tensile force caused by the first tensile members 124*a* and the second tensile members 124*b* may be equally distributed throughout a full width of the first flange 112.

In operation S116, excavated soil is excavated by an excavator.

Although the present invention has been described in detail through representative examples above, those of ordinary skill in the art to which the present invention pertains will understand that various modifications can be made to the above-described embodiments without departing from the scope of the present invention. Therefore, the scope of this disclosure is defined not by the detailed description of the invention but by the appended claims, and all differences within the scope will be construed as being included in the present invention.

What is claimed is:

1. A temporary earth-retaining structure comprising:

a pile having a H-beam shape and provided with a first flange at a backfill soil side and a second flange at an excavated soil side;

a ground anchor provided with an anchor of which one end is anchored to a lower portion of backfill soil and a tensile member extending from the other end of the anchor to sequentially pass through the first flange and the second flange; and a guide bracket disposed on a ground of the backfill soil while being fixed to the first flange at an upper portion of the pile, and changing a direction of the tensile member, which is wired parallel to a longitudinal direction of the pile into a direction perpendicular to the longitudinal direction of the pile into a direction perpendicular to the longitudinal direction of the pile from a lower portion of the backfill soil so as to be guided toward the second flange, wherein the guide bracket comprises:

a plurality of side plates spaced a predetermined distance from each other on the first flange to protrude toward the outside of the first flange and provided in a plate shape to prevent the tensile member from being separated outward from a side surface of the guide bracket; and a direction change rotation plate disposed between the plurality of side plates at outer ends of the plurality of side plates and having a curved contact surface with the tensile member so that the tensile member is changed in direction perpendicular to the longitudinal direction of the pile, wherein the tensile member comprises a first tensile member and a second tensile member, wherein the first tensile member and the second tensile member are disposed adjacent to each other at the other end of the anchor so as to be integrated with each other, wherein, as the first tensile member and the second tensile member are closer to the direction change rotation plate from the other end of the anchor, a spaced distance therebetween increases, and the first tensile member and the second tensile member sequentially pass through the first flange and the second flange in a state which the spaced distance therebetween from a point that is in contact with the direction change rotation plate is constantly maintained.

2. The temporary earth-retaining structure of claim 1, wherein the first tensile member and the second tensile member are wired to be adjacent to inner surfaces of the plurality of side plates so as to be spaced at a predetermined distance from the inside of the guide bracket, and a rounded protrusion configured to maintain the spaced distance between the first tensile member and the second tensile member and fix positions of the first tensile member and the second tensile member on the direction change rotation plate so that tensile force caused by the first tensile member and the second tensile member is equally distributed throughout a full width of the first flange is provided to protrude from a top surface of the direction change rotation plate.

3. The temporary earth-retaining structure of claim 2, wherein the direction change rotation plate is seated and fixed on a bottom plate disposed perpendicular to the first flange 112 between the plurality of side plates, and the bottom plate is provided to protrude in a direction perpendicular to the first flange so as to be supported by a rib attached to a lower portion of the bottom plate.

4. The temporary earth-retaining structure of claim 3, wherein the rounded protrusion is provided to be spaced a predetermined distance from each of the inner surfaces of the plurality of side plates from a top surface of the direction change rotation plate.

5. The temporary earth-retaining structure of claim 4, wherein the rounded protrusion has a curved shape that is inclined so that a protruding height of the rounded protrusion on the top surface of the direction change rotation plate decreases as it moves from a central portion to an edge of the rounded protrusion.

6. The temporary earth-retaining structure of claim 5, wherein a groove is provided in the top surface of the direction change rotation plate to seat the rounded protrusion, and the rounded protrusion is seated and assembled in the groove.

7. The temporary earth-retaining structure of claim 2, wherein, at upper ends of the plurality of side plates adjacent to the first flange, an upper plate configured to prevent the first tensile member and the second tensile member from being separated outward from an upper side of the guide bracket is disposed between the plurality of side plates.

8. A method for constructing the temporary earth-retaining structure by using the guide bracket of claim 1, the method comprising:

forming a first drill hole inside backfill soil;

anchoring a ground anchor in the first drill hole;

inserting a pile into a second drill hole formed to be spaced a predetermined distance from the first drill hole;

installing the guide bracket on an upper portion of the pile;

changing a direction of each of first tensile member and the second tensile member, which are wired parallel to a longitudinal direction of the pile from a lower portion of the backfill soil, to a direction perpendicular to the longitudinal direction of the pile by the guide bracket so as to be guided from the first flange to the second flange;

tensioning the first tensile member and the second tensile member; and allowing the first tensile member and the second tensile member to be spaced a predetermined distance from each other by a direction change rotation plate and a rounded protrusion of the guide bracket in the process of tensioning the first tensile member and the second tensile member so that tensile force by the first tensile member and the second tensile member is equally distributed throughout a full width of the first flange.

* * * * *